United States Patent [19]

Dagdagan

[11] Patent Number: 5,046,651

[45] Date of Patent: Sep. 10, 1991

[54] TUBULAR FRAME SUPPORT FOR CONVERTIBLE CHILD CARRIER

[76] Inventor: Leon Dagdagan, 156 Pacer Dr., Vallejo, Calif. 94591

[21] Appl. No.: 361,993

[22] Filed: Jun. 5, 1989

[51] Int. Cl.[5] ..... A45F 4/02

[52] U.S. Cl. ..... 224/155; 224/153; 224/160

[58] Field of Search ..... 224/158, 159, 160, 161, 224/153, 155; 297/118, 174

[56] References Cited

U.S. PATENT DOCUMENTS

| | | | |
|---|---|---|---|
| 3,097,773 | 7/1963 | Cunningham . | |
| 3,253,860 | 5/1966 | Shapiro | 297/174 |
| 3,421,670 | 1/1969 | Hansson . | |
| 3,713,568 | 1/1973 | Sloan . | |
| 3,989,173 | 11/1976 | Gebhard . | |
| 4,044,931 | 8/1977 | Catelli . | |
| 4,230,362 | 10/1980 | Euwema et al. . | |
| 4,248,478 | 2/1981 | Aron . | |
| 4,312,535 | 1/1982 | Smith . | |
| 4,368,835 | 1/1983 | Murphy . | |
| 4,415,200 | 11/1983 | Bourne | 297/174 |
| 4,428,514 | 1/1984 | Elf . | |
| 4,469,373 | 9/1984 | Simmons et al. . | |
| 4,506,928 | 3/1985 | Marion . | |
| 4,568,120 | 2/1986 | Hoffman . | |
| 4,585,271 | 4/1986 | Wu . | |
| 4,586,746 | 5/1986 | Day et al. . | |
| 4,620,711 | 11/1986 | Dick . | |
| 4,746,044 | 5/1988 | Arvizu et al. . | |
| 4,747,526 | 5/1988 | Launes . | |
| 4,762,256 | 8/1988 | Whitaker . | |

FOREIGN PATENT DOCUMENTS

| | | | |
|---|---|---|---|
| 349382 | 11/1960 | Switzerland | 224/161 |

*Primary Examiner*—Linda J. Sholl

[57] ABSTRACT

A tubular frame support for a convertible child carrier which makes it possible for a child backpack (FIG. 2) to be converted to a child's seat adapted to a table as a high chair (FIG. 3) and vice-versa. The parallel side members of the tubular frame support are configured like a letter "J": each side member having a first elongated section (15), a parallel second elongated section (11 & 12) which is half the length of the first elongaged section, and a curved connecting section (13) connecting the first and second elongated sections. The first elongated section (15) is bent towards the open end of the second elongated section (11) where the open end of the first elongated section is in line with the second elongated section with a space therebetween where a table can be inserted. The presence of the second elongated section (11 & 12) makes it possible to create a convertible child carrier.

1 Claim, 4 Drawing Sheets

TUBULAR FRAME SUPPORT FOR CONVERTIBLE CHILD CARRIER

BACKGROUND OF INVENTION

1. Field of Invention

This invention generally relates to child carriers convertible to form a child backpack or to form a child seat adapted to be mounted to a table as a high chair.

2. Description of the Prior Art

The usefulness of child carriers such as backpacks and child seats adapted to be mounted to a table as high chairs are well known. However they can become a bit of a hassle when they are taken along when going out. Eventually only one carrier is taken. Both carriers can also take up a lot of space at home and can create clutter. Consequently, there is a need for a carrier that can provide both conveniences in one.

A number of backpacks that are convertible to strollers and car seats are known to exist but patent search has not revealed any backpack that is convertible to a high chair, nor a high chair convertible to a backpack.

OBJECTS AND ADVANTAGES

Accordingly the object of this invention is to create a child carrier convertible to form a child backpack or a child seat adapted to be mounted to a table as a high chair. Another object of this invention is to create a child's flexible seat that can be secured to the tubular frame where it can hang to be used to carry a child or be released to be cleaned. This and other objects will become more evident with the following description of the accompanying drawings.

BRIEF DISCUSSION OF THE DRAWINGS

FIG. #1 shows the preferred manner in which the invention's tubular frame support is preferably configured.

FIG. #2 shows the tubular frame support with the child's flexible seat incorporated therein to create a backpack.

FIG. #3 shows the tubular frame support with the child's flexible seat incorporated therein to create a high chair.

FIG. #4 is an example of how the side member frames of the prior art is configured.

FIG. #5 shows the prefered manner in which the invention's tubular side member frames is configured drawn beside FIG. #4 to highlight the difference between the old and new art.

FIG. #6, 7 & 8 shows examples in which the invention's tubular side member frames can also be configured and which are basically the same as #5.

DETAILED DESCRIPTION OF A PREFERRED EMBODIMENT

Figure 1:
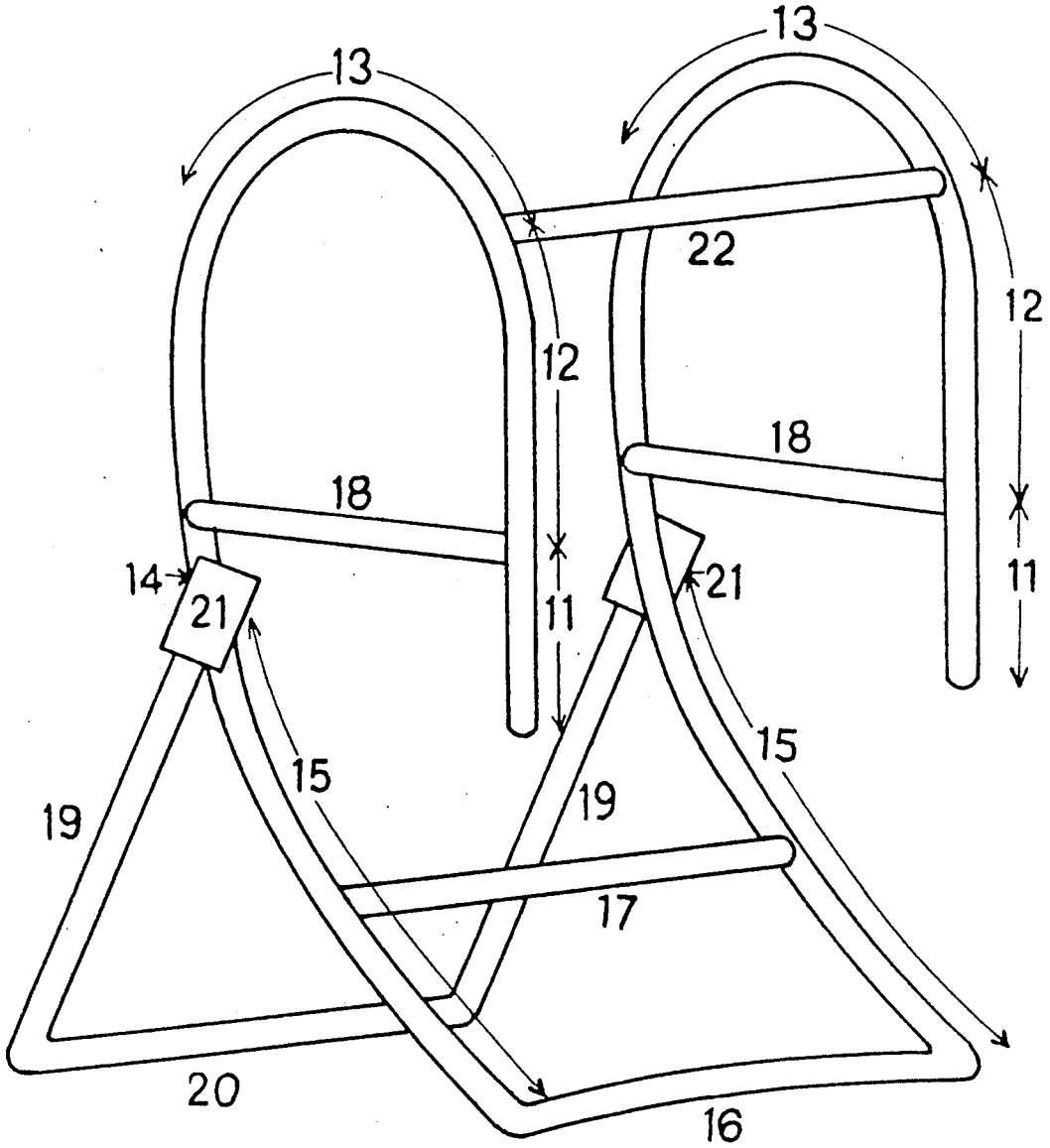

The most important improvement of this invention over prior art relates to the manner in which a tubular frame support for a child carrier is configured (FIG. 1). Specifically, it relates to the manner in which a pair of symmetrical parallel tubular J-shaped side members of the tubular frame support are configured and the manner in which they are connected to each other.

Each side member has three principal sections connected on a single plane and configured like a letter "J" comprising: a first elongated section (15) which is about the length of a person's back as measured from the shoulders to the waist, a parallel second elongated section (11 & 12) which is about half the length of the first elongated section, and a curved connecting section (13), of about 25 cm. in length, connecting the two directly opposite ends of the first and second elongated sections. The first elongated section (15) is curved towards the open end of the second elongated section (11 & 12) where the open end of the first elongated section is almost aligned in a straight line with the second elongated section with a space therebetween. The second elongated section has two smaller sections of about equal lengths: a middle section (12) and an end section (11). (These side members shall henceforth be called J-frames.) These J-frames are connected parallel about a shoulder's width apart by three tubular cross bars to create a single unit.

A first tubular cross bar (16) is connected coaxially, by any conventional means, to the J-frames at the ends of the first elongated section (15). If preferred, the three principal sections of the J-frames and the first tubular cross bar can be formed from a single tubular piece.

A second tubular cross bar (17) is connected coaxially, by any conventional means, to the first elongated section of the J-frames, about 7 cm. parallel to the first tubular cross bar (16).

A third tubular cross bar (22) is connected coaxially, by any conventional means, close to the junction of the curved connecting section (13) and the second elongated section (11 & 12).

A side bar (18) is connected, by any conventional means, to the elongated sections of the J-frames from the junction of the middle section (12) and the end section (11) to the first elongated section (15).

Figure 4:
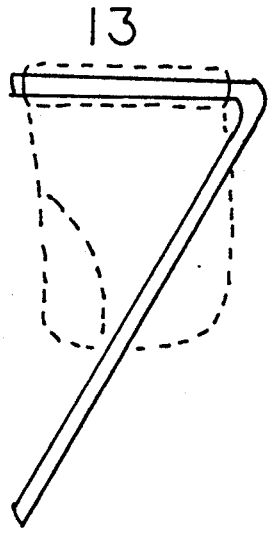
FIG 4 PRIOR ART
Figure 5:
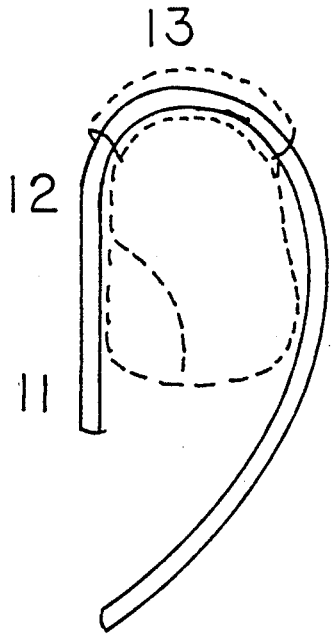

The J-frame's second elongated section (11 & 12) is what makes this invention different and improved over prior art. Prior art's tubular frames have side members that has only one elongated section making them appear like the number "7" (FIG. 4) as compared to two elongated sections of the current invention making them appear like the letter "J". FIG. 5 illustrates what the present invention's tubular frame look like drawn next to FIG. 4 to highlight the difference between current and prior art. (Examples of prior art patents are: Pat. Nos. 4,762,256; 4,747,526; 4,746,044; 4,044,931; 3,989,173; 3,713,568; 3,421,670; and 3,097,773). The second elongated section (11 & 12) of the J-frames makes it possible to convert a child backpack to a child seat adapted to be mounted to a table as a high chair. This will become more apparent with further discussions.

OPERATION

Figure 2:
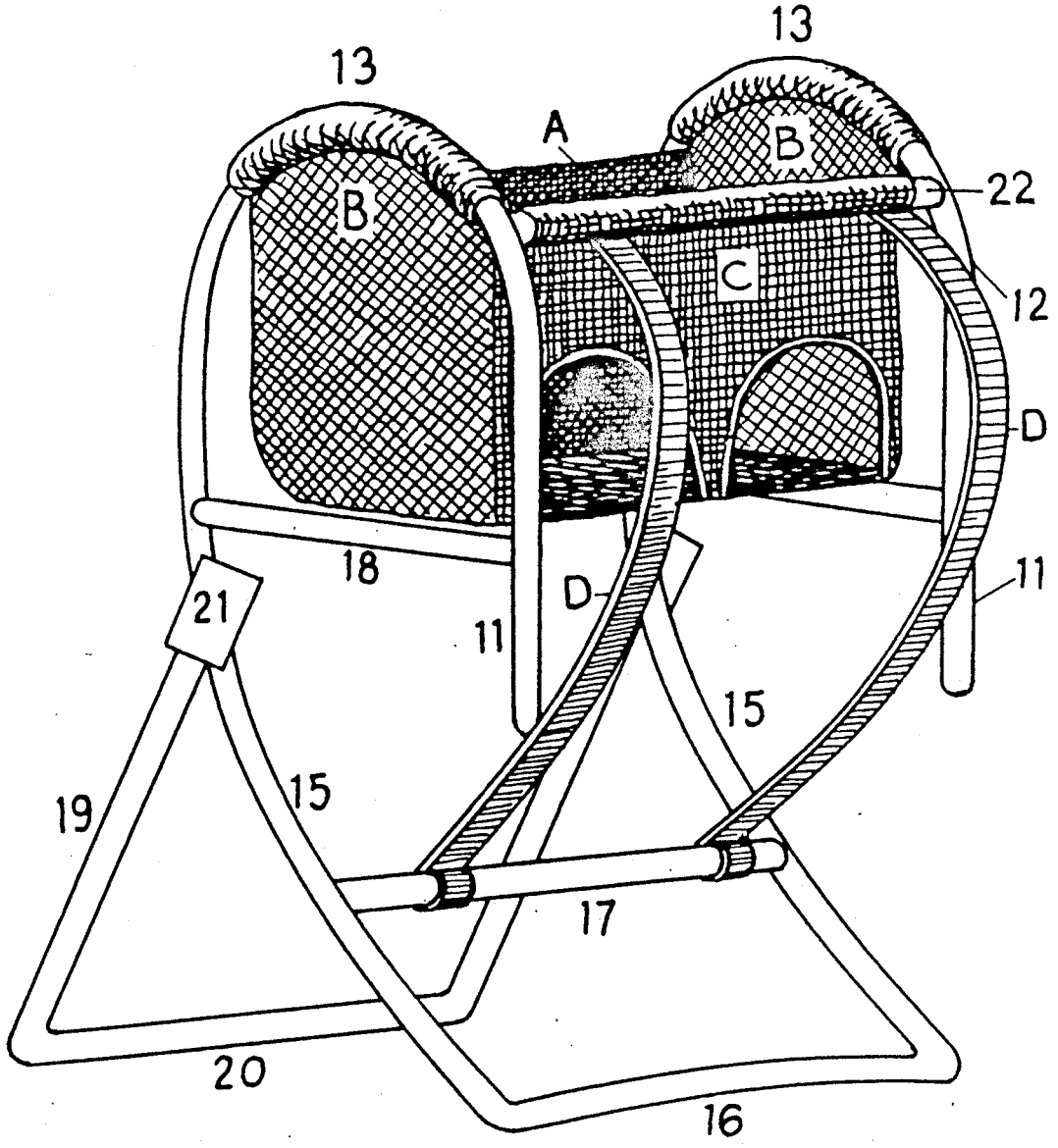

To create the child backpack (FIG. #2), a child's flexible seat, made of flexible material configured like a pouch and adapted to support a child from the crotch and buttocks to the upper portion of the body in a natural facing forward position, is hung by its sides (B), using releasble fasteners, onto the curved connecting section (13) of the J-frames and is also hung by its front (C), using releasable fasteners, onto the third tubular cross bar (22). The third tubular cross bar (22) rests on the shoulders of an adult carrying a child and is secured to the back of the adult by shoulder straps (D) which are attached to the front (C) of the child's flexbible seat. The second tubular cross bar (17), which adds stability to the J-frames, can also be used to attach the other end of the shoulder straps. The first tubular cross bar (16) anchors to the buttocks of the adult when the carrier is used as the child backpack and is also a base for the tubular frame when the carrier is upright on a level surface as in FIG. 2. The tubular frame's pair of leg members connected to a fourth cross bar forming a "U" (19), is attached to about the middle (14) of the first elongated section of the J-frames by the use of a resilent detent (21) which keeps the legstand open when it is used to support the tubular frame in an upright manner (FIG. 2) or keeps it retracted when the backpack is on the back of the adult. Any conventional resilient detent can be used for this purpose.

Figure 3:
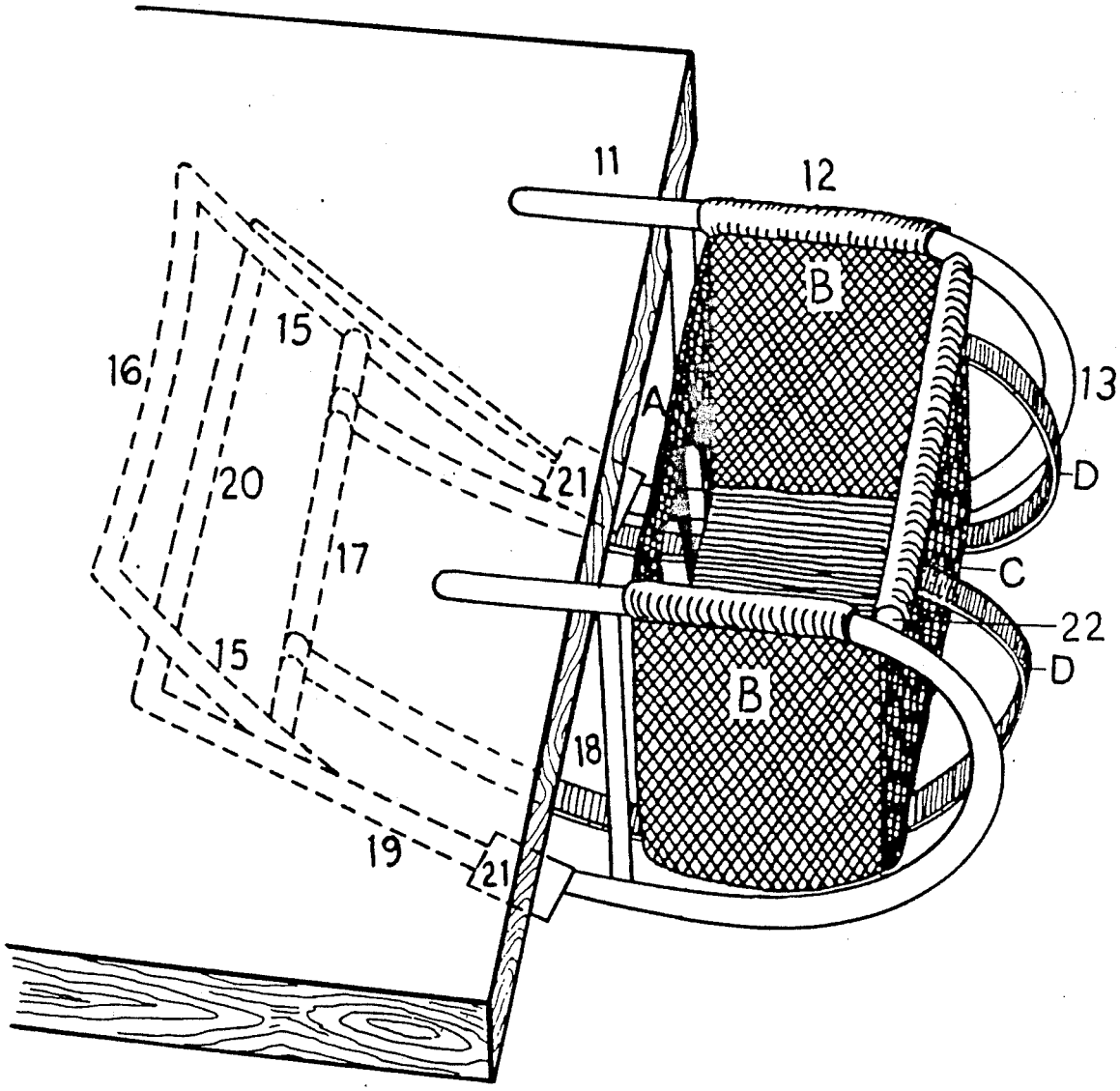

To convert the child's backpack to a child's seat adapted to be mounted to a table as a high chair (FIG. 3), the child's flexible seat must hang in the middle section (12) of the second elongated section of the J-frames. There are two ways to accomplish this. One way requires the sides (B) of the child's flexible seat, that hangs onto the curved connecting section (13) to create the child backpack (FIG. 2), to be released. Then, with the front (C) of the child's flexible seat still hanging onto the third tubular cross bar (22, FIG. 1), the child's flexible seat is flipped over the third tubular cross bar (22, FIG. 1) towards the middle section (12) of the second elongated section where the sides (B) of the child's flexible seat is now hung (FIG. 3). Another way (not shown) is to simply release the entire child's flexible seat from where it hangs as the child backpack and place it in the middle section (12) where the sides (B) are hung to the middle section (12) and where the back (A) is hung, using releasable fasteners, to the third tubular cross bar (22). To convert back to the backpack, the reverse is done. The frame is then mounted to the table's edge in a cantilevered manner by placing the end section (11) on the top side of a table while the first tubular cross bar (16) is anchored to the underside of the table creating the child's seat adapted to be mounted to the table as the high chair.

As one can see, without the second elongated section (11 & 12) of the J-frames, converting the child backpack to the child seat adapted to be mounted to the table as the high chair would be unlikely.

The side bars (18) acts as a stop when the carrier is mounted to the table and also stabilizes and prevents up and down bouncing of the tubular frame when the child is in the child seat.

The child's flexible seat, which hangs onto the J-frames with releasable fasteners can be completely released so that it can be thoroughly washed—something prior art does not provide.

SUMMARY, RAMIFICATIONS AND SCOPE

What is here provided, is a new and improved child carrier. The tubular frame's side members are basically shaped like the letter "J" in contrast to prior art patents which is best described as configured like a number "7". The difference enables this invention to provide the tubular frame support for the backpack which can be converted to the child seat adapted to be mounted to the table as the high chair and vice versa.

Figure 6:
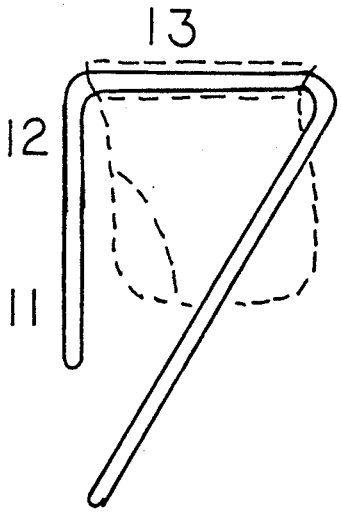
Figure 8:
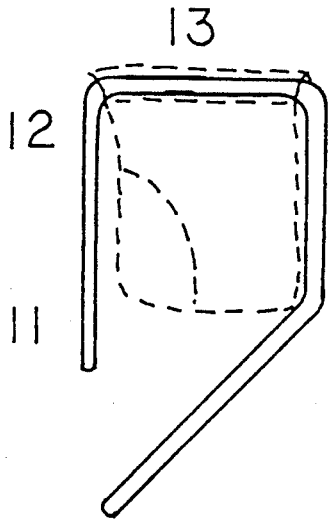
Figure 7:
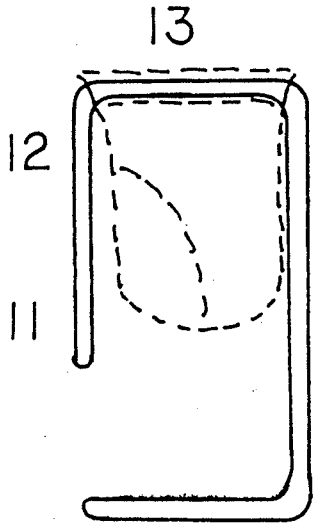

While this invention has been described in connection with preferred embodiments thereof, it is obvious that modifications and changes therein may be made by those skilled in the art to which it pertains without departing from the spirit and scope of the invention, such as modifications in the manner in which the J-frames are configured as illustrated by FIGS. 6, 7, & 8 which show that the tubular side frames wherein the child's seat can be hung are still basically J-shaped in configuration, having the first elongated section and the very important second elongated section, without which, convertion of the child backpack into the child seat adapted to be mounted to the table as the high chair, and vice versa, would be unlikely. Accordingly, the scope the this invention is to be limited only by the appended claim.

What I claim is:

1. A child carrier comprising:

a pair of parallel tubular frames; each frame consisting of a first elongated section having a first end and a second end, and a second elongated section having a first end and a second end; said first elongated section being longer than said second elongated section; said second end of said first elongated section and said first end of said second elongated section being connected by a curved connecting section structured such that said first end of said first elongated section extends beyond the second end of said second elongated section to form a gap between the two ends and the first end of said first elongated section extends to a point where it would meet the second end of said second elongated section if further extended;

each parallel tubular frame further including a side bar having a first end connected near the second end of said first elongated section and a second end connected in the middle of said second elongated section;

said pair of parallel tubular frames being connected together by a first tubular cross bar at the first ends of the first elongated sections, a second tubular cross bar at a distance of approximately one-third of the length of the first elongated sections from the first ends of the first elongated sections, and a third tubular cross bar at the first ends of the second elongated sections;

a pair of leg members each having a first end and a second end, the first ends of said leg members being connected to a fourth tubular cross bar and the second ends of said leg members being pivotally connected near the second ends of the first elongated sections;

a seat made of flexible material having a front portion, a back portion, two side portions and a bottom portion; said front portion having means for releasably attaching said seat to said third tubular cross bar, and two holes sized to accommodate the legs of a child; said back portion having means for releasably attaching said seat to said third tubular cross bar; said two side portions having means for releasably attaching said seat to said pair of parallel tubular frames;

and a pair of shoulder straps each having a first end connected to said front portion of said seat and an second end connected to said second tubular cross bar;

whereby said carrier is convertible to three positions; the first position being as a backpack where said side portions of the seat are attached to the curved connecting section and said front portion of the seat is attached to the third tubular cross bar; the second position being a highchair where said side portions of the seat are attached to the second elongated section and said back portion of the seat is attached to the third tubular cross bar and a table is inserted into said gap; and the third position being a seat where the first elongated sections and leg members are pivoted apart to form a ground support for the carrier.

* * * * *